United States Patent [19]

Mallory et al.

[11] 4,004,515

[45] Jan. 25, 1977

[54] SEQUENTIAL JET SHAPED CHARGE

[75] Inventors: Herbert D. Mallory, China Lake, Calif.; Frank R. Marquardt, Fairfax, Va.

[73] Assignee: The United States of America as represented by the Secretary of the Navy, Washington, D.C.

[22] Filed: Jan. 25, 1971

[21] Appl. No.: 109,543

[52] U.S. Cl. ..... 102/24 HC; 102/56 SC

[51] Int. Cl.[2] ..... F42B 3/08; F42B 13/10

[58] Field of Search ..... 102/24 HC, 56

[56] References Cited

UNITED STATES PATENTS

| | | | |
|---|---|---|---|
| 3,215,074 | 11/1965 | Robinson, Jr. et al. | 102/24 HC |
| 3,416,449 | 12/1968 | Brothers | 102/56 |

*Primary Examiner*—Verlin R. Pendegrass
*Attorney, Agent, or Firm*—R. S. Sciascia; Roy Miller; Gerald F. Baker

[57] ABSTRACT

An explosive device comprising a plurality of serially spaced shaped charges with a flat metal washer at the base of each upper charge which washer is propelled across an annular space, at a known velocity, to impact and thereby initiate the explosive charge driving the next jet in sequence. A metal shield down the center of the charge provides a channel for passage of the jets generated and also, said shield by collapsing under the action of the explosive, propels a particular washer associated therewith and clips off the slow non-penetrating end of each jet, minimizing the required time delay between jets.

3 Claims, 3 Drawing Figures

*INVENTORS*
HERBERT D. MALLORY
FRANK R. MARQUARDT
*BY* ROY MILLER
ATTORNEY.
GERALD F. BAKER
AGENT.

SEQUENTIAL JET SHAPED CHARGE

BACKGROUND OF THE INVENTION

Sequential jet shaped charge systems comprise a series of explosively driven, hollow metal cones which collapse under the force of a detonating explosive to form metallic jets capable of great penetrating power. In the sequential jet system, the first formed jet drills its hole, the second jet enters the same hole and deepens it, and so on. In this way a very deep hole may be formed by a small diameter system. A hole of similar depth, made by a single cone system, would require the use of a much larger diameter cone. In many instances a large diameter single-cone system is virtually impossible of achievement. For example, a gun-fired projectile is diameter limited; if the projectile incorporates a shaped charge to penetrate armor, the diameter of the shaped charge is also limited. With the use of sequential jets, however, penetration can be increased.

In designing sequential jet shaped charge devices it has been found that timing is very important to assure that no interaction occurs between jets in flight. This timing is all important because interaction or interference greatly degradates performance. Prior sequential jet shaped charge systems have been largely unworkable because they lacked the necessary timing capability.

SUMMARY OF THE INVENTION

According to the present invention a sequential jet shaped charge system of general applicability is provided which yields a relatively high penetration capability in a small diameter device. The preferred form of this invention incorporates a flat metal washer or "transfer plate" at the base of each upper charge. Upon actuation, this metal washer is propelled across an air space at a known velocity to impact and thereby initiate the explosive charge driving the next jet in sequence. A metal shield tube runs down the center of the charge providing a channel for passage of the jets and also, by collapsing under the action of the explosive which propels a particular transfer plate, clips off the slow nonpenetrating end of each jet, thus minimizing the required time delay between jets. By minimizing time delays the total system lengths may be greatly shortened. Typical delays run on the order of 30 to 50 microseconds.

DESCRIPTION OF THE INVENTION

Figure 1:
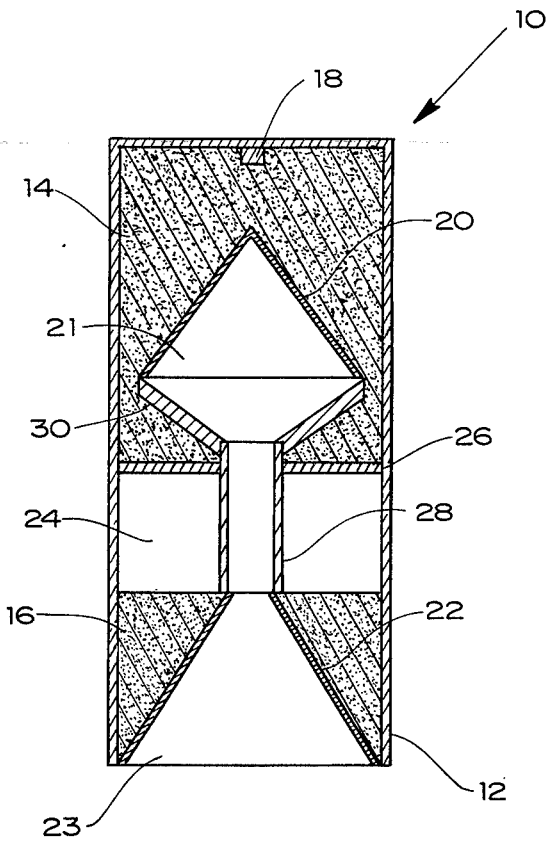
FIG. 1 is a schematic illustration of a sequential shaped charge device manufactured according to the invention.

The device 10 shown on the drawing comprises two shaped charge elements 14, 16 in a housing 12. A booster pellet 18 is inserted in the explosive charge 14 to initiate detonation and a transfer plate 26 is placed intermediate of these two charges for transfering detonation, after a time delay, to the second charge 16. Each of charges 14 and 16 is provided with a liner 20, 22, respectively, and the conical cavities 21, 23 formed thereby are connected by a shield tube 28.

Figure 2:
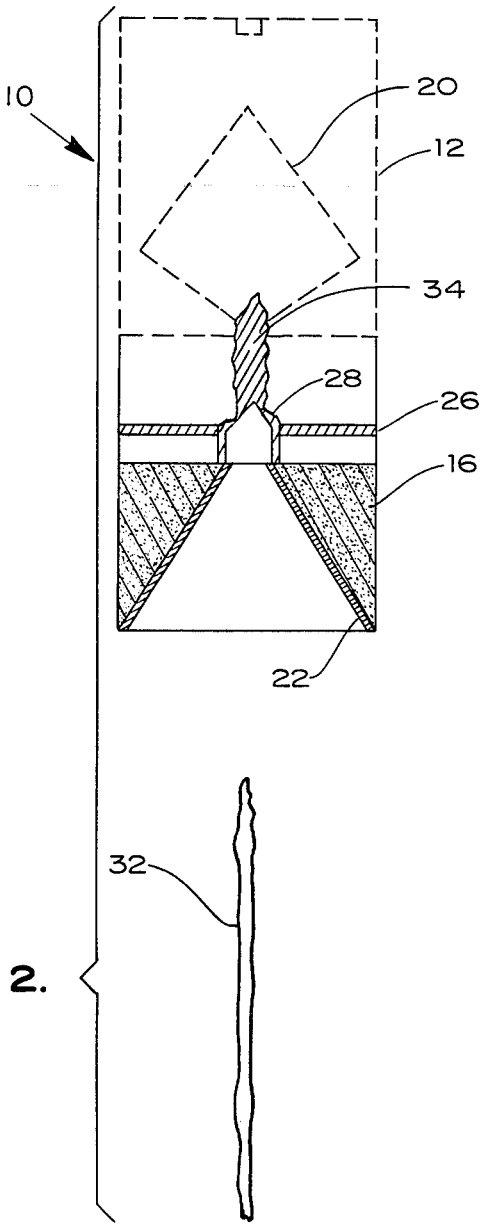
FIG. 2 is a schematic view of the device of FIG. 1 depicting the action taking place a few microseconds after detonation.

In FIG. 2 the explosive 14 has been expended and the cone 20 represented by dotted line 20' has been converted into a jet 32 and a rear slug portion 34. The transfer plate 26 has moved down from the dotted line position to the solid line position as shown and the shield tube has been partially consumed or destroyed by the movement of the jet and slug. Note that the relatively slower moving slug is being further impeded by the implosion of tube 28 under pressure from the lower portion of explosive 14.

Figure 3:
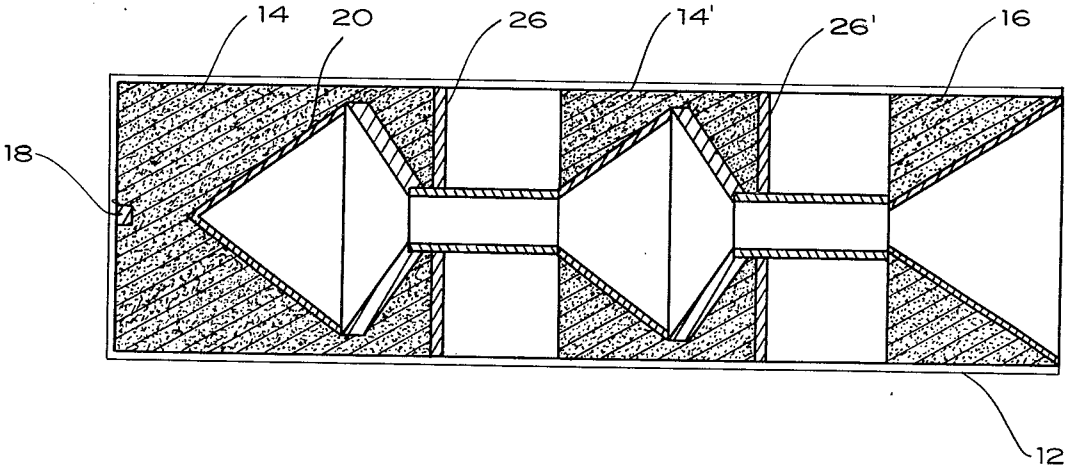
FIG. 3 is a diagramatic cross sectional view of a sequential system of three shaped charges.

From the view shown in FIG. 3, it may be seen how one or more additional charges 14' may be placed between the initial charge 14 and the terminal charge 16.

OPERATION

A shaped charge jet in flight possesses a velocity gradient from tip to rear, i.e., the jet tip has a much higher velocity than the rear, the results of which are that the jet elongates in flight. Optimum elongation is essential for good penetration, hence, a shaped charge — depending on its size and construction — requires a certain "standoff" from the target. For proper sequential jet action, the first jet must be completely expended in the target before the second jet tip arrives at the bottom of the hole drilled by the first jet. since the velocity of a jet tip may be two to five times the velocity of the jet rear, and the jets must not touch one another in flight in order to prevent degradation of action, the time between jets must be relatively long and closely controlled.

The formation of a jet is invariably accompanied by the formation of a large, slow, slug of cone metal which does not contribute to target penetration. The slug from the first jet can, however, interfere with the second or later collision and thus degrade performance of the system. The timing system which is the subject of this invention thus performs two essential functions:

a. It clips off the slow, nonpenetrating, rear portion of each jet formed, and
b. Provides a time delay sufficient to prevent in-flight collision of the sequential jets due to the fast tip of a subsequent jet overtaking the slower rear of a preceding jet. The time delay designed into each sequential jet system is based on the assumption that the system will be used at a given standoff since timing requirements change with standoff, other things being equal.

The preferred form of this invention incorporates a flat metal washer (the "transfer plate") at the base of each upper charge which is propelled across an annular air space, at a known velocity, to impact and thereby initiate the explosive charge driving the next jet in the sequence. A metal shield tube down the center of the charge provides a channel for passage of the jets and, also, by collapsing under the action of the explosive which propels a particular transfer plate, clips off the slow nonpenetrating end of each jet in order to minimize the required time delay between jets. Minimum time delays are required in order to keep the total system length as short as practicable. Typical delays are 30 to 50 microseconds.

Advantages of the device according to this invention are that:

a. proper timing between jets is provided which prevents inflight interaction and subsequent loss in jet penetration, and b. jet clipping of the slower, useless portions is provided for which effectively shortens the overall system length and makes it more useful in volume-limited situations.

The metal of the transfer plate and its thickness can be varied along with the dimensions of the air space across which it is propelled; changes in these variables change the effective delay time between jets. The only other requirement is that the transfer plate velocity must be sufficiently high to cause reproducible initiation of the explosive around the next lower cone.

What is claimed is:

1. An explosive assembly comprising:

an elongated housing having a longitudinal axis of symmetry, an initiation end, and a terminal end;

a first shaped explosive charge supported in the initiation end of said housing and having an opening therein;

at least one additional shaped explosive charge supported in the terminal end of said housing and having an opening therethrough;

said first and additional charges being spaced apart in said housing so that a torroidal air space exists therebetween;

each said opening and space having an axis of symmetry coincident with said longitudinal axis of symmetry;

a hollow tube connecting said openings through said space; and a torroidal metal transfer plate fastened in said assembly adjacent the base of said first charge for transferring detonation between said first and said additional charge.

2. The assembly of claim 1 further comprising:

one or more intermediate shaped charges spaced in said housing between said first and said additional charges;

each said intermediate charge having a detonation transfer space between it and the next lower charge; and like means in each such space for transferring detonation to said lower charge.

3. A sequential jet shaped charge explosive device comprising:

an elongated cylindrical housing having an initiation end and a terminal end;

a plurality of shaped charge explosive means spaced lengthwise within said housing;

one of said shaped charge means being adjacent said initiation end and comprising explosive initiating means;

each said shaped charge means being spaced from each other shaped charge means by a measured space;

a metal transfer plate positioned in each said space adjacent the bottom of that shaped charge means nearest said initiation means;

the arrangement of said shaped charge means and said transfer plate means being such that when each said shaped charge is detonated, the transfer plate means adjacent thereto is propelled across said space impinging upon and detonating the next shaped charge.

* * * * *